US010638898B2

(12) United States Patent
Chiu et al.

(10) Patent No.: US 10,638,898 B2
(45) Date of Patent: May 5, 2020

(54) ELECTRONIC DEVICE

(71) Applicant: IBOT Robotic Co. Ltd., Taipei (TW)

(72) Inventors: Tai-Yu Chiu, Taipei (TW); Chun-Chieh Huang, Taipei (TW)

(73) Assignee: IBOT Robotic Co. Ltd., Taipei (TW)

( * ) Notice: Subject to any disclaimer, the term of this patent is extended or adjusted under 35 U.S.C. 154(b) by 197 days.

(21) Appl. No.: 15/880,505

(22) Filed: Jan. 25, 2018

(65) Prior Publication Data

US 2018/0213986 A1 Aug. 2, 2018

Related U.S. Application Data

(60) Provisional application No. 62/453,483, filed on Feb. 1, 2017.

(30) Foreign Application Priority Data

Nov. 22, 2017 (TW) ..... 106140478 A

(51) Int. Cl.

| | |
|---|---|
| ***A47L 9/28*** | (2006.01) |
| ***A47L 5/28*** | (2006.01) |
| ***A47L 5/22*** | (2006.01) |
| ***A47L 5/38*** | (2006.01) |
| ***A47L 5/24*** | (2006.01) |
| *A47L 9/04* | (2006.01) |

(52) U.S. Cl.

CPC ..... *A47L 5/28* (2013.01); *A47L 5/225* (2013.01); *A47L 5/24* (2013.01); *A47L 5/38* (2013.01); *A47L 9/2842* (2013.01); *A47L 9/2884* (2013.01); *A47L 9/0477* (2013.01); *A47L 2201/00* (2013.01)

(58) Field of Classification Search

CPC ..... A47L 9/28; A47L 9/1608; A47L 9/1616; A47L 5/24

See application file for complete search history.

(56) References Cited

U.S. PATENT DOCUMENTS

| | | | | |
|---|---|---|---|---|
| 5,709,007 | A | 1/1998 | Chiang | |
| 7,568,259 | B2 * | 8/2009 | Yan | A47L 5/225 15/319 |
| 9,532,690 | B2 * | 1/2017 | Jang | A47L 5/225 |

(Continued)

FOREIGN PATENT DOCUMENTS

| | | |
|---|---|---|
| JP | 2003180587 | 7/2003 |
| JP | 3187463 U | 11/2013 |
| TW | M468289 U | 12/2013 |

OTHER PUBLICATIONS

"Search Report of European Counterpart Application," dated Jun. 1, 2018, pp. 1-6.

*Primary Examiner* — Michael D Jennings

(74) *Attorney, Agent, or Firm* — Patterson + Sheridan, LLP

(57) ABSTRACT

An electronic device including a self-propelled machine body and a portable machine body is provided. The self-propelled machine includes a moving module and has a first air flow channel. The portable machine body is detachably installed on the self-propelled machine body, and the portable machine body includes a suction motor. When the portable machine body is installed on the self-propelled machine body, the suction motor communicates with the first air flow channel, and the self-propelled machine body and the portable machine body are collectively actuated as a sweeping robot.

20 Claims, 8 Drawing Sheets

(56) References Cited

U.S. PATENT DOCUMENTS

2013/0269148 A1* 10/2013 Chiu ..... A47L 5/225
15/329
2013/0305484 A1* 11/2013 Dyson ..... A47L 9/009
15/353
2014/0289998 A1* 10/2014 Wang ..... A47L 9/22
15/340.1

* cited by examiner

ELECTRONIC DEVICE

CROSS-REFERENCE TO RELATED APPLICATION

This application claims the priority benefits of U.S. provisional application Ser. No. 62/453,483, filed on Feb. 1, 2017, and Taiwan application serial no. 106140478, filed on Nov. 22, 2017. The entirety of each of the above-mentioned patent applications is hereby incorporated by reference herein and made a part of this specification.

BACKGROUND

1. Technical Field

The disclosure relates to an electronic device. More particularly, the disclosure relates to an electronic device configured for cleaning.

2. Description of Related Art

Normal indoor cleaning includes floor cleaning, one of the most common types of cleaning. A number of convenient cleaning machines, e.g., commonly seen vacuum cleaners and automatic sweeping robots, have been invented and launched, so as to reduce labor burden. However, since a user often has a variety of cleaning needs, e.g., the automatic sweeping robot and the manually operated vacuum cleaner, it is often necessary to purchase both products, thus consuming more money and storage space.

SUMMARY

The disclosure provides an electronic device, a portable machine body of which may be optionally combined with a self-propelled machine body and may collectively act as a sweeping robot or may be detached from the self-propelled machine body and optionally combined with other components.

An electronic device provided in an embodiment of the invention includes a self-propelled machine body and a portable machine body. The self-propelled machine body includes a moving module and a first air flow channel. The portable machine body is detachably installed on the self-propelled machine body and includes a suction motor. When the portable machine body is installed on the self-propelled machine body, the suction motor of the portable machine body communicates with the first air flow channel of the self-propelled machine body, and the self-propelled machine body and the portable machine body are collectively actuated as a sweeping robot.

In an embodiment of the invention, the electronic device further includes a suction head assembly, wherein when the portable machine body is separated from the self-propelled machine body, the suction head assembly may be detachably connected to the portable machine body, and when the suction head assembly is installed on the portable machine body, the portable machine body and the suction head assembly are adapted to be collectively actuated as a handheld vacuum cleaner.

In an embodiment of the invention, the self-propelled machine body includes a first dust-collecting box connected to the first air flow channel, and the suction head assembly includes a second air flow channel and a second dust-collecting box connected to the second air flow channel, wherein when the suction head assembly is installed on the portable machine body, the suction motor of the portable machine body communicates with the second air flow channel of the suction head assembly.

In an embodiment of the invention, the portable machine body includes a handlebar and an operation interface.

In an embodiment of the invention, the portable machine body includes a power supply module electrically connected to the suction motor, and when the portable machine body is installed on the self-propelled machine body, the moving module of the self-propelled machine body is electrically connected to the power supply module of the portable machine body.

In an embodiment of the invention, the self-propelled machine body includes a first electrical connector electrically connected to the moving module, and the portable machine body includes a second electrical connector electrically connected to the power supply module. When the portable machine body is installed on the self-propelled machine body, the first electrical connector is joined with the second electrical connector.

In an embodiment of the invention, the self-propelled machine body includes a first electrical connector and a first circuit board electrically connected to the first electrical connector, and the portable machine body includes a second electrical connector and a second circuit board electrically connected to the second electrical connector. When the portable machine body is installed on the self-propelled machine body, the first electrical connector is joined with the second electrical connector, so that the first circuit board is electrically connected to the second circuit board.

In an embodiment of the invention, the self-propelled machine body includes a third electrical connector. When the portable machine body is installed on the self-propelled machine body, the third electrical connector is electrically connected to the power supply module, and an external power is adapted to be transmitted from the third electrical connector to the power supply module.

In an embodiment of the invention, the portable machine body includes a fourth electrical connector electrically connected to the power supply module, and an external power is adapted to be transmitted from the fourth electrical connector to the power supply module.

In an embodiment of the invention, the self-propelled machine body includes a first housing, and the moving module is rotatably disposed at the first housing. The first housing includes a first inlet, a first outlet, and the first air flow channel communicating with the first inlet and the first outlet. The portable machine body includes a second housing, and the suction motor is disposed in the second housing. The second housing includes a second inlet and a second outlet, and the suction motor communicates with the second inlet and the second outlet. When the portable machine body is installed on the self-propelled machine body, the second inlet is connected to the first outlet.

In an embodiment of the invention, the electronic device further includes an elastic washer disposed at the first outlet of the first housing or disposed at the second inlet of the second housing.

In an embodiment of the invention, the self-propelled machine body includes a first housing having a receiving groove, and when the portable machine body is installed on the self-propelled machine body, the portable machine body is located in the receiving groove.

In an embodiment of the invention, the receiving groove communicates with the first air flow channel.

In an embodiment of the invention, the first housing includes a plurality of position-limiting walls surrounding the receiving groove, and the plurality of position-limiting walls is respectively adapted to limit the portable machine body located in the receiving groove so as to prevent the portable machine body from moving in a plurality of directions relative to the self-propelled machine body.

In an embodiment of the invention, the self-propelled machine body includes a first fixing portion, and the portable machine body includes a second fixing portion. When the portable machine body is installed on the self-propelled machine body, the second fixing portion is fixed to the first fixing portion.

In an embodiment of the invention, the first fixing portion and the second fixing portion are a combination of a hook and a slot or a combination of two magnetic pieces.

In an embodiment of the invention, the moving module includes a wheel or a track.

Based on the foregoing, the portable machine body of the electronic device provided in one or more embodiments of the invention is detachably installed on the self-propelled machine body. When the portable machine body is installed on the self-propelled machine body, the suction motor of the portable machine body communicates with the first air flow channel of the self-propelled machine body. Therefore, when the suction motor of the portable machine body is activated, the first air flow channel of the self-propelled machine body may correspondingly become a part of a vacuum channel, so that the self-propelled machine body and the portable machine body may be collectively actuated as a sweeping robot with automatic moving and vacuuming functions. In addition, the portable machine body may also be detached from the self-propelled machine body, and the portable machine body not installed on the self-propelled machine body may be combined with other components (e.g., the suction head assembly). When the suction head assembly is installed on the portable machine body, the portable machine body and the suction head assembly, for example, may be collectively actuated as the hand-held vacuum cleaner. In other words, the electronic device provided in one or more embodiments of the invention may be combined with different components to optionally become different types of electronic cleaning devices. As such, a user of the electronic device provided herein may enjoy diverse usage modes at less costs, and the storage space for the electronic device may be reduced.

To make the aforementioned features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1:
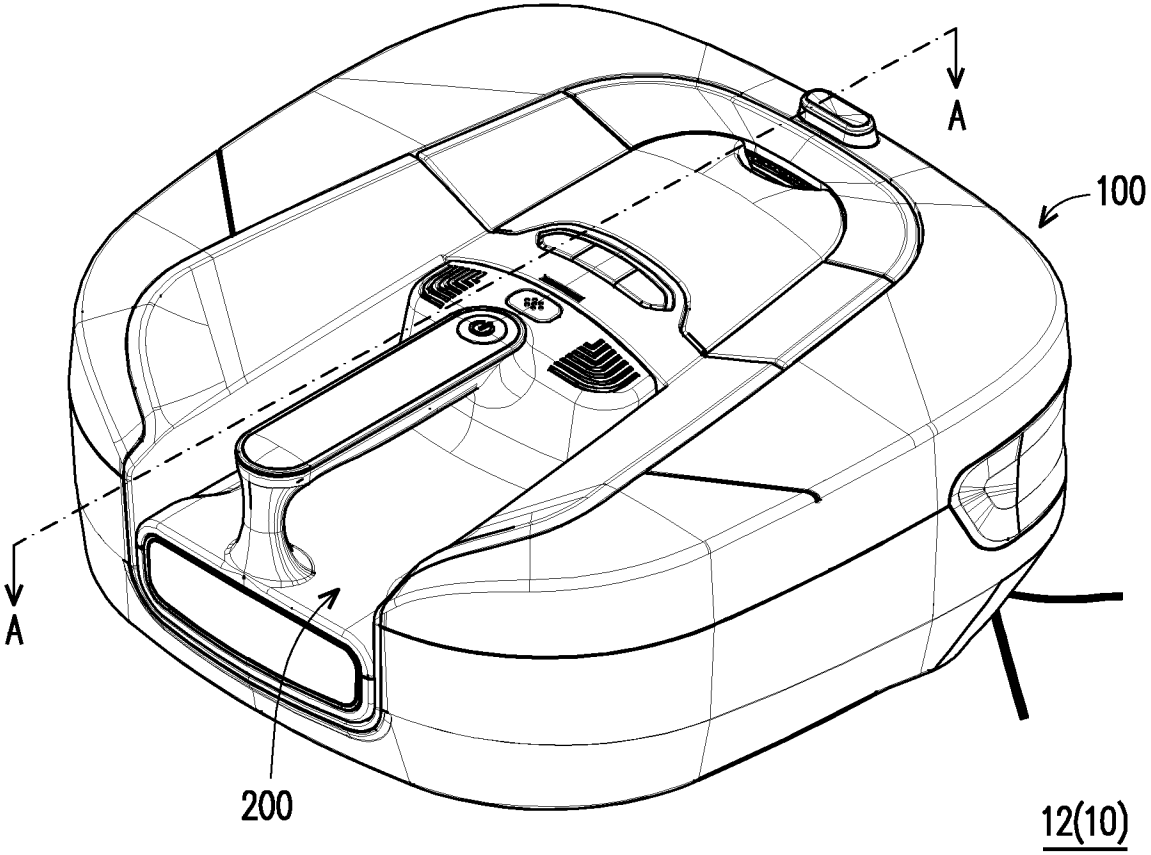
FIG. 1 is a schematic view of an electronic device according to an embodiment of the invention.
Figure 2:
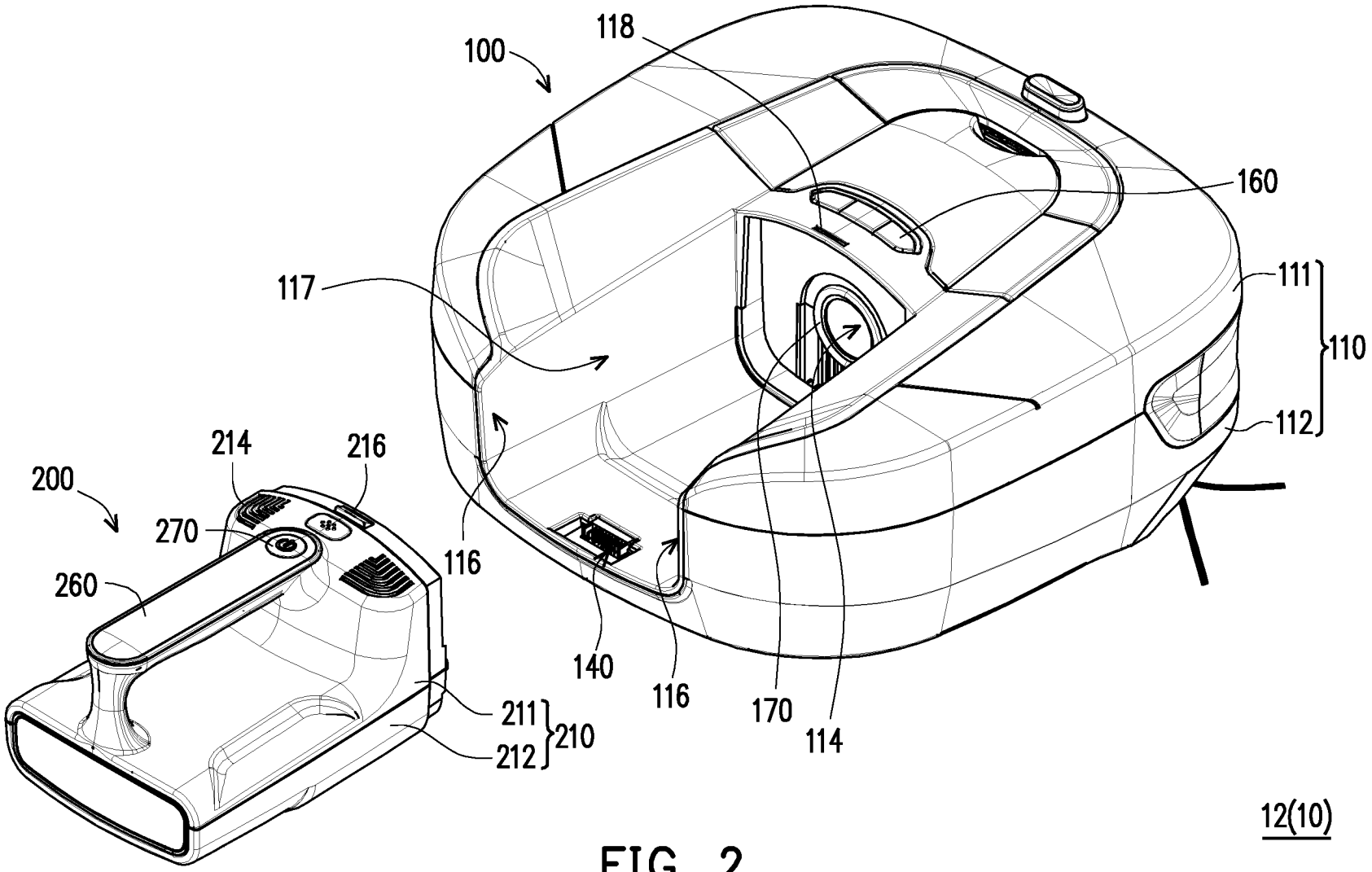
FIG. 2 is a schematic view of a portable machine body separated from a self-propelled machine body of the electronic device depicted in FIG. 1.

FIG. 1 is a schematic view of an electronic device according to an embodiment of the invention. FIG. 2 is a schematic view of a portable machine body separated from a self-propelled machine body of the electronic device of FIG. 1. Referring to FIG. 1 and FIG. 2, an electronic device 10 provided in the embodiment includes a self-propelled machine body 100 and a portable machine body 200. The self-propelled machine body 100 serves as a movable base that may be configured to hold the portable machine body 200 and is adapted to move the portable machine body 200. As shown in FIG. 1 and FIG. 2, the portable machine body 200 provided in the embodiment is detachably installed on the self-propelled machine body 100. When the portable machine body 200 is installed on the self-propelled machine body 100, the self-propelled machine body 100 and the portable machine body 200 may be collectively actuated as a sweeping robot 12.

Figure 3:
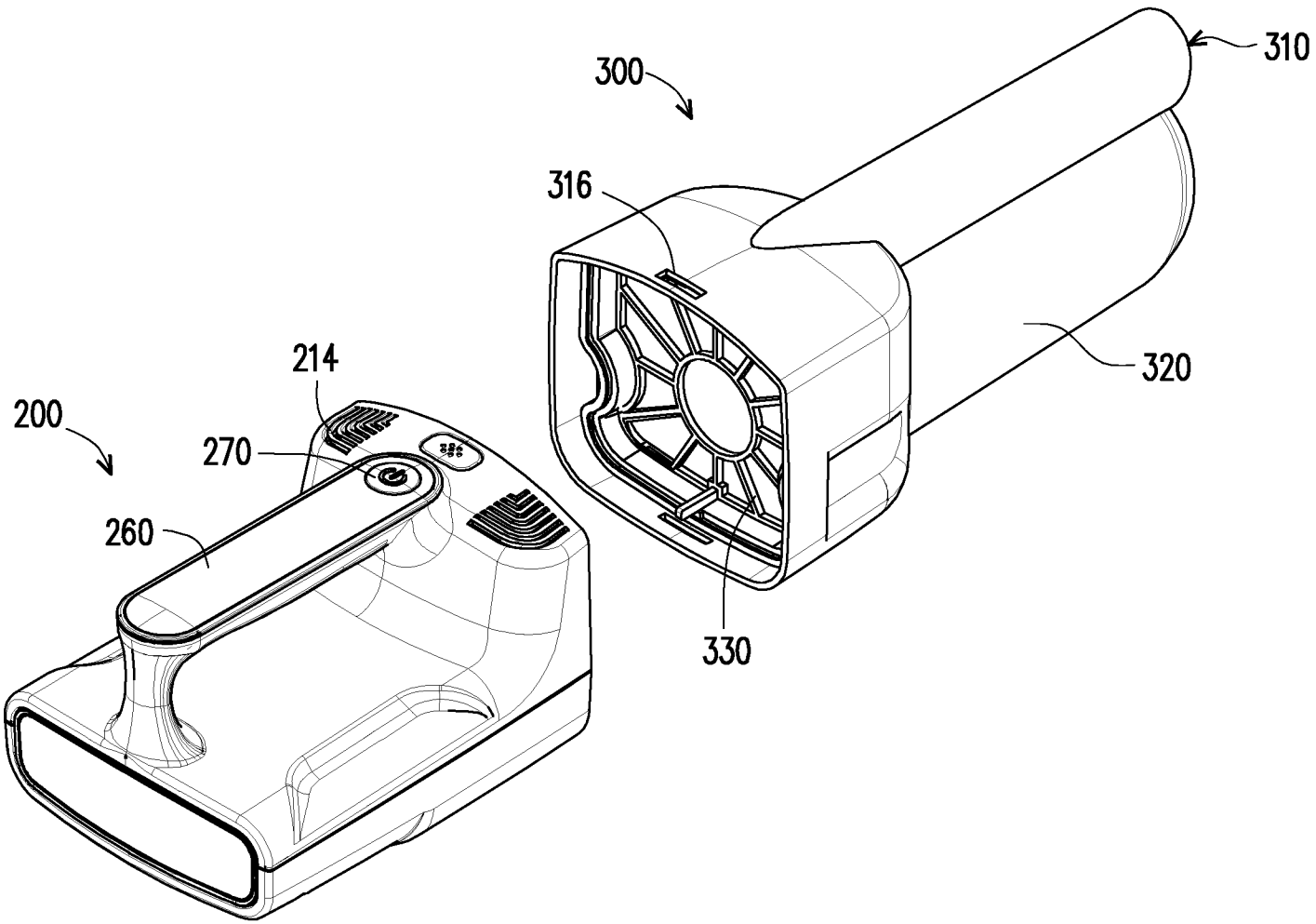
FIG. 3 and FIG. 4 are schematic views of a suction head assembly before and after combined with the portable machine body depicted in FIG. 2.
Figure 4:
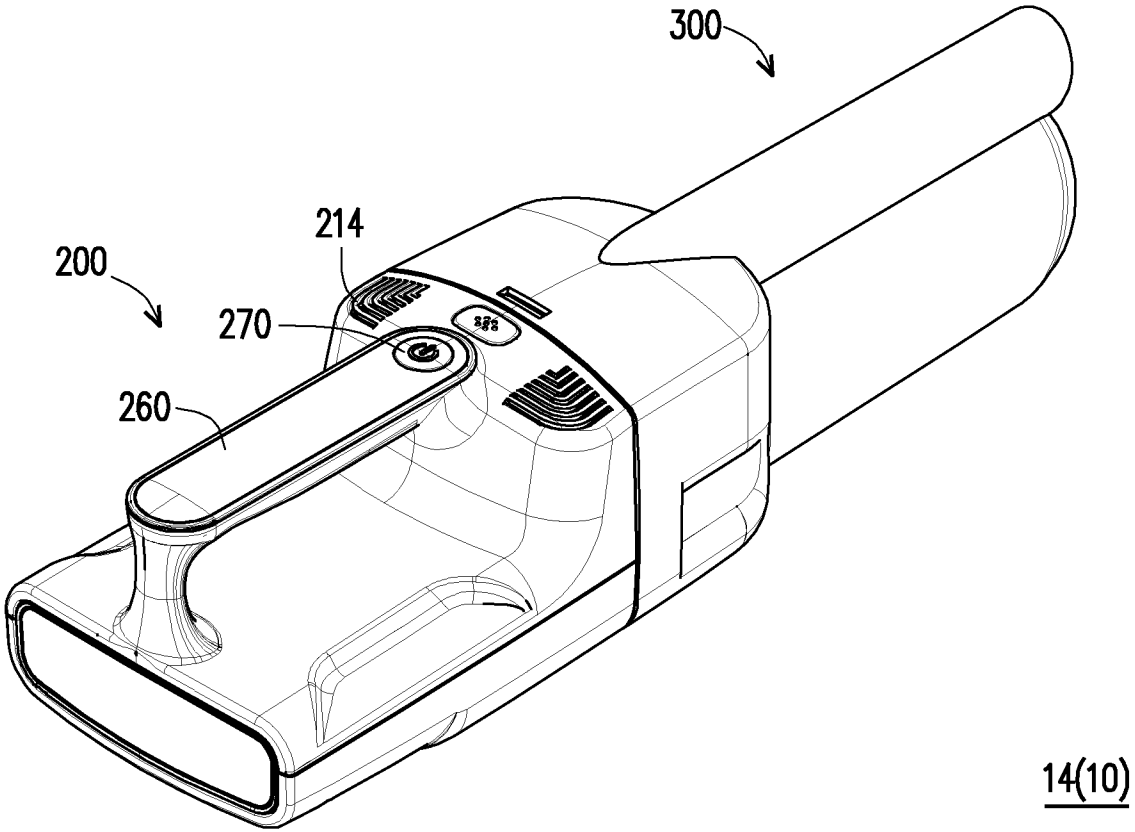

The portable machine body 200 provided in the embodiment may also be detached from the self-propelled machine body 100 as shown in FIG. 2, and the portable machine body 200 may connect with other components. FIG. 3 and FIG. 4 are schematic views of a suction head assembly before and after combined with the portable machine body depicted in FIG. 2. Referring to FIG. 3 and FIG. 4, the electronic device 10 further includes a suction head assembly 300. The suction head assembly 300 provided in the embodiment is detachably connected to the portable machine body 200. As shown in FIG. 4, when the suction head assembly 300 is installed on the portable machine body 200, the portable machine body 200 and the suction head assembly 300 may be collectively actuated as a hand-held vacuum cleaner 14.

That is, the portable machine body 200 provided in the embodiment may be optionally installed on the self-propelled machine body 100 and be actuated as the sweeping robot 12 as shown in FIG. 1 and FIG. 2. The portable machine body 200 may also be optionally connected to the suction head assembly 300 and be actuated as the hand-held vacuum cleaner 14 as shown in FIG. 3 and FIG. 4. Therefore, the electronic device 10 provided in the embodiment is able to meet different needs of a user because of combinations of the portable machine body 200 with different components. The self-propelled machine body 100, the portable machine body 200, and the suction head assembly 300 of the electronic device 10 are described in detail below.

Figure 5:
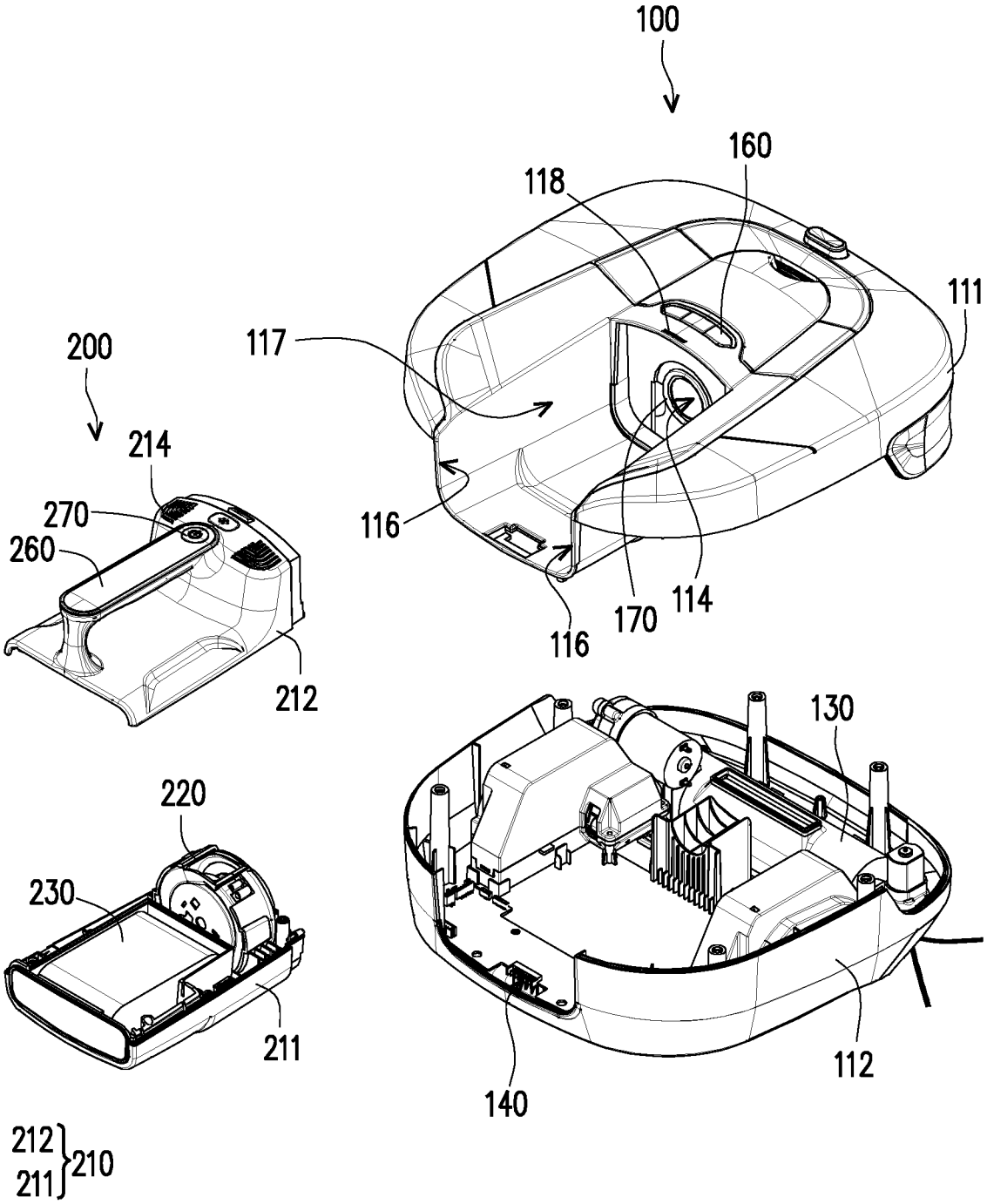
FIG. 5 is a schematic view of the electronic device depicted in FIG. 2, wherein an upper housing and a lower housing of the electronic device are separated from each other.
Figure 6:
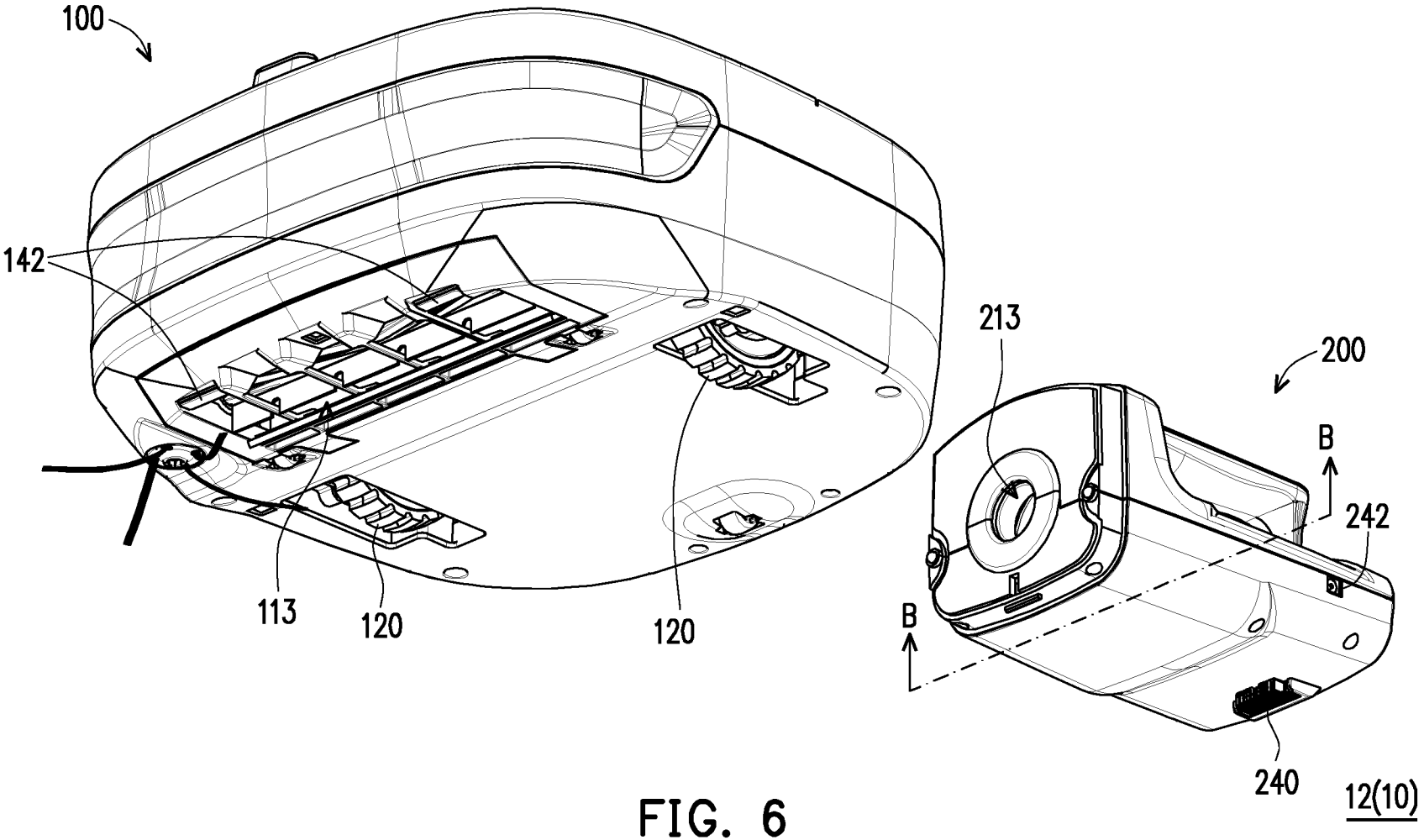
FIG. 6 is a schematic view of FIG. 2 at another view angle.
Figure 7:
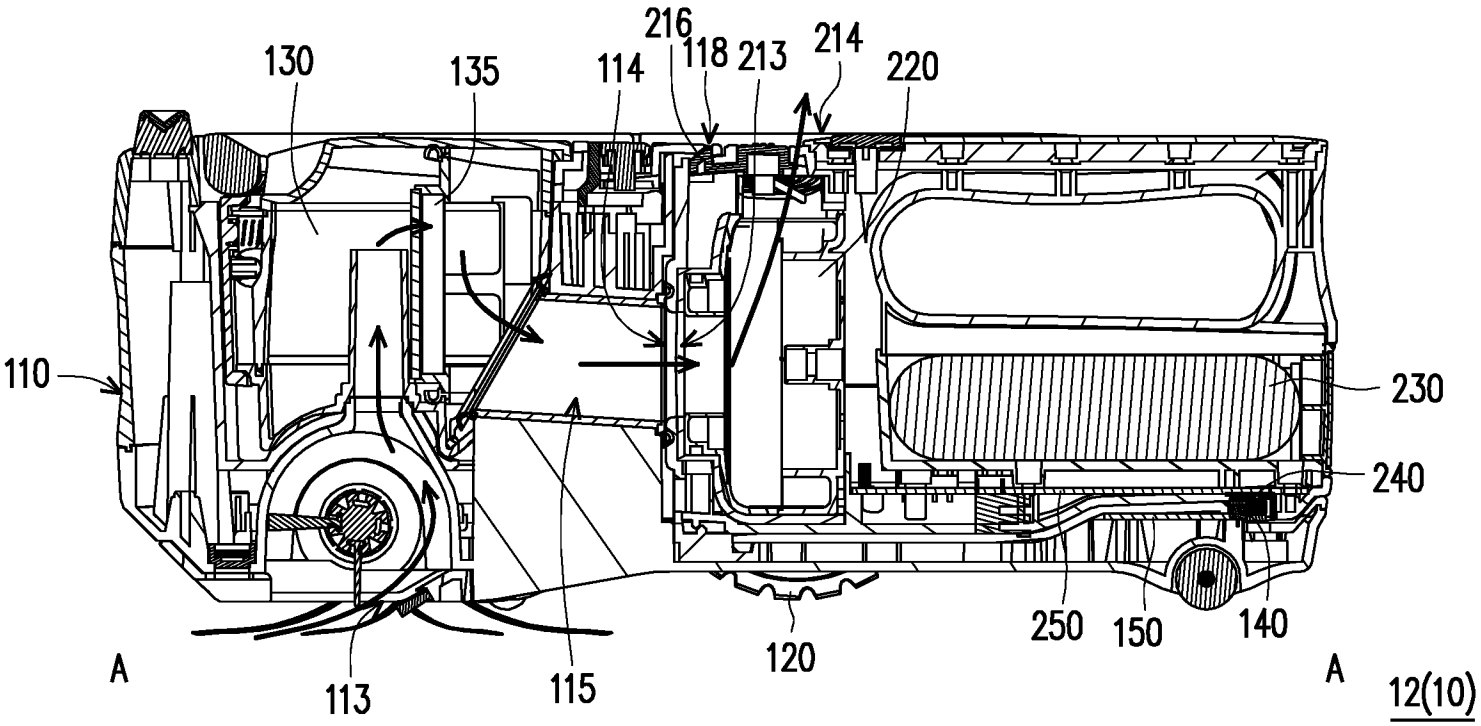
FIG. 7 is a schematic cross-sectional view along a line A-A segment depicted in FIG. 1.
Figure 8:
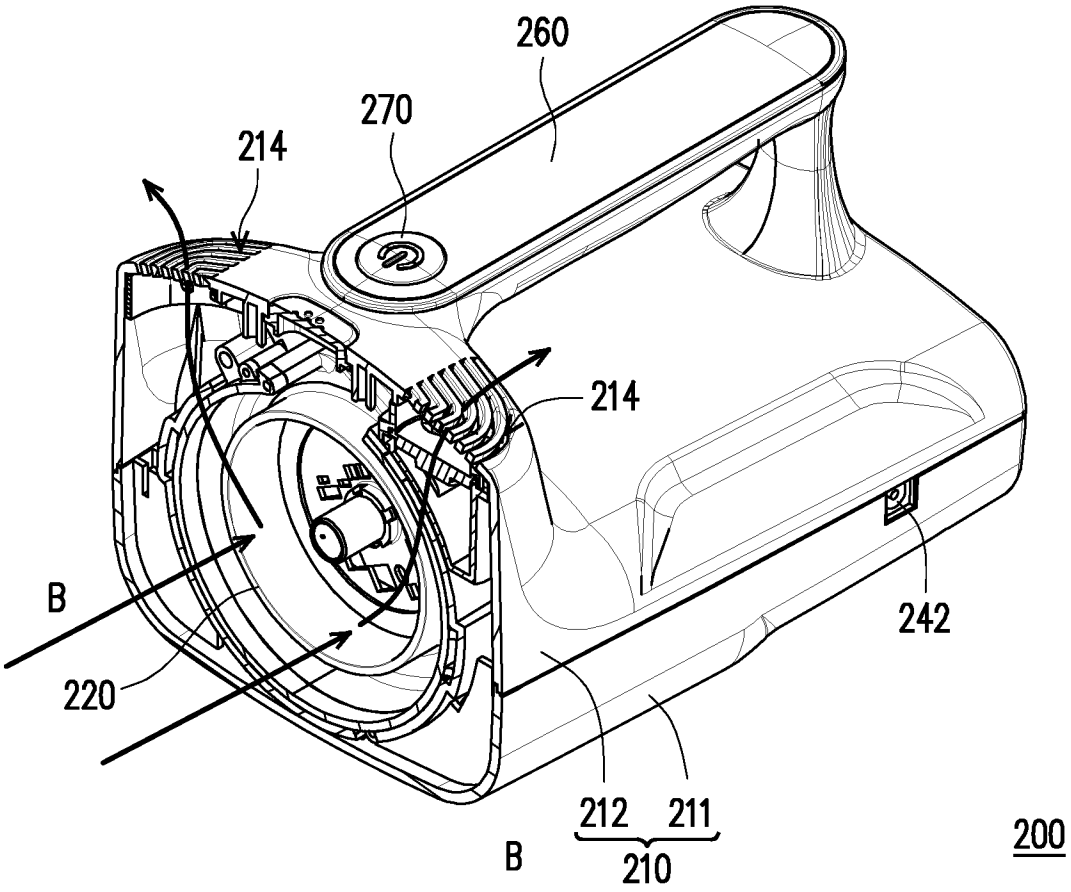
FIG. 8 is a schematic cross-sectional view of the portable machine body depicted in FIG. 6 along a line segment B-B.

FIG. 5 is a schematic view of the electronic device depicted in FIG. 2, wherein an upper housing and a lower housing of the electronic device are separated from each other. FIG. 6 is a schematic view of FIG. 2 at another view angle. FIG. 7 is a schematic cross-sectional view along a line A-A segment depicted in FIG. 1. FIG. 8 is a schematic cross-sectional view of the portable machine body depicted in FIG. 6 along a line segment B-B.

With reference to FIG. 5 to FIG. 8, the self-propelled machine body 100 provided in the embodiment includes a first housing 110 (shown in FIG. 6), a first operation interface 160, a moving module 120 (shown in FIG. 6), a first dust-collecting box 130, a filter 135 (shown in FIG. 7), a first electrical connector 140, and a first circuit board 150 (shown in FIG. 7). The first housing 110 provided in the embodiment includes a first upper housing 111 and a first lower housing 112. Certainly, the first housing 110 is not limited to what is described above. In other embodiments, the first housing 110 may also be a combination of left and right housings, one single housing, or a combination of more than two housings.

In the embodiment, an interior space exists between the first upper housing 111 and the first lower housing 112, and the first dust-collecting box 130, the filter 135 (shown in FIG. 7), and the first circuit board 150 (shown in FIG. 7) are disposed in the interior space between the first upper housing 111 and the first lower housing 112. In addition, the first upper housing 111 and the first lower housing 112 constitute a portion of a vacuum channel. As shown in FIG. 7, the first housing 110 provided in the embodiment includes a first inlet 113, a first outlet 114, and a first air flow channel 115 communicating with the first inlet 113 and the first outlet 114. An air flow may enter the first housing 110 from the first inlet 113, flow along the first air flow channel 115 within the first housing 110, and then exit the first housing 110 via the first outlet 114.

As shown in FIG. 7, the moving module 120 and the first electrical connector 140 provided in the embodiment are electrically connected to the first circuit board 150, respectively. In addition, the moving module 120 provided in the embodiment is rotatably disposed at and exposed from the first lower housing 112. The moving module 120 is exemplified by a wheel, but the type of the moving module 120 is not limited thereto. In other embodiments, the moving module 120 may also be a track or other movable mechanisms.

In addition, as shown in FIG. 5, the first operation interface 160 is exposed from the first upper housing 111 and is electrically connected to the first circuit board 150. The first operation interface 160 provided in the embodiment is, for example, a physical button, but the type of the first operation interface 160 is not limited thereto. In other embodiments, the first operation interface 160 may also be a touch panel. Besides, as shown in FIG. 5, the first housing 110 provided in the embodiment includes a receiving groove 117 and a plurality of position-limiting walls 116 surrounding the receiving groove 117. The receiving groove 117 may accommodate the portable machine body 200 and communicates with the first outlet 114. The first electrical connector 140 provided in the embodiment is exposed from the first upper housing 111 and is located in the receiving groove 117. The first electrical connector 140 is adapted to be electrically connected to the portable machine body 200 placed in the receiving groove 117.

The portable machine body 200 provided in the embodiment includes a second housing 210, a suction motor 220, a power supply module 230, a second operation interface 270, a second electrical connector 240 (shown in FIG. 6), and a second circuit board 250 (shown in FIG. 7). In the present embodiment, the suction motor 220, the power supply module 230, the second electrical connector 240, and the second operation interface 270 are electrically connected to the second circuit board 250, respectively. In addition, as shown in FIG. 5 and FIG. 7, the second operation interface 270 is exposed from the second housing 210, and the suction motor 220, the power supply module 230, and the second circuit board 250 are disposed in the second housing 210. The power supply module 230 provided in the embodiment is, for example, a rechargeable battery, but the type of the power supply module 230 is not limited thereto. In addition, the second operation interface 270 provided in the embodiment is, for example, a physical button, but the type of the second operation interface 270 is not limited thereto. In other embodiments, the second operation interface 270 may also be the touch panel.

The second housing 210 provided in the embodiment includes a second upper housing 211 and a second lower housing 212. A portion of the second upper housing 211 forms a handlebar 260 for the user to hold. Certainly, the second housing 210 is not limited to what is described above. In other embodiments, the second housing 210 may also be the combination of left and right housings, one single housing, or a combination of more than two housings. Moreover, in other embodiments, a position of the handlebar 260 is not limited to the position shown in the drawings.

As shown in FIG. 7, the second housing 210 includes a second inlet 213 and a second outlet 214. The suction motor 220 communicates with the second inlet 213 and the second outlet 214. With reference to FIG. 7, when the portable machine body 200 is installed on the self-propelled machine body 100, the second inlet 213 of the second housing 210 is connected to the first outlet 114 of the first housing 110. If the suction motor 220 is activated, after a dust-laden air flow enters from the first inlet 113 of the self-propelled machine body 100, the dust is brought to the first dust-collecting box 130 disposed beside the filter 135, and the air flow passes through the filter 135, flows along the first air flow channel 115 to the first outlet 114, the second inlet 213 of the portable machine body 200, and the suction motor 220, and then exits via the second outlet 214. In other words, when the portable machine body 200 is installed on the self-propelled machine body 100, a channel between the first inlet 113 of the self-propelled machine body 100 to the second outlet 214 of the portable machine body 200 becomes the vacuum channel of the sweeping robot 12. Moreover, as shown in FIG. 7, a large portion of the vacuum channel of the sweeping robot 12 is located in the self-propelled machine body 100.

Referring back to FIG. 5, the electronic device 10 provided in the embodiment further includes an elastic washer 170 disposed at the first outlet 114 of the first housing 110 or disposed at the second inlet 213 of the second housing 210. When the portable machine body 200 is installed on the self-propelled machine body 100, the elastic washer 170 is sandwiched between a wall of the first housing 110 close to the first outlet 114 and a wall of the second housing 210 close to the second outlet 214, so as to ensure that the vacuum channel between the portable machine body 200 and the self-propelled machine body 100 is kept airtight. A material of the elastic washer 170 provided in the embodiment is, for example, rubber or silicone, but the material and the type of the elastic washer 170 are not limited thereto. Certainly, in other embodiments, the elastic washer 170 may also be omitted.

As provided in the present embodiment and shown in FIG. 5 to FIG. 7, a part of the first housing 110 close to the first outlet 114 or a part of the second housing 210 close to the second inlet 213 are exemplified as a plane, respectively. However, in other embodiments, the part of the first housing 110 close to the first outlet 114 or the part of the second housing 210 close to the second inlet 213 may also be of a concave-convex arrangement. In other words, when the portable machine body 200 is installed on the self-propelled machine body 100, the part of the first housing 110 close to the first outlet 114 may extend into the part of the second housing 210 close to the second inlet 213, or the part of the second housing 210 close to the second inlet 213 may extend into the part of the first housing 110 close to the first outlet 114, so as to enhance airtightness between the first outlet 114 and the second inlet 213. Certainly, the form of an interface between the part of the first housing 110 close to the first outlet 114 and the part of the second housing 210 close to the second inlet 213 is not limited thereto.

In addition, as shown in FIG. 5 and FIG. 7, the self-propelled machine body 100 provided in the embodiment includes a first fixing portion 118, and the portable machine body 200 provided in of the embodiment includes a second fixing portion 216. When the portable machine body 200 is installed on the self-propelled machine body 100, the second fixing portion 216 is fixed to the first fixing portion 118, so as to further secure the portable machine body 200 and the self-propelled machine body 100. The first fixing portion 118 and the second fixing portion 216 provided in the embodiment are a combination of a hook and a slot. In other embodiments, the first fixing portion 118 and the second fixing portion 216 may also be a combination of two magnetic pieces. The type of the first fixing portion 118 and the type of the second fixing portion 216 are not limited thereto.

In addition, as shown in FIG. 2 or FIG. 5, the position-limiting walls 116 surrounding the receiving groove 117 provided in the embodiment are respectively adapted to limit the portable machine body 200 located in the receiving groove 117, so that the portable machine body 200 does not move in a plurality of directions relative to the self-propelled machine body 100. For example, two opposite position-limiting walls 116 provided in the embodiment may prevent the portable machine body 200 from moving in a left-right direction relative to the self-propelled machine body 100. Certainly, the position of the position-limiting walls 116 and a direction to which the portable machine body 200 is limited are not limited thereto.

In addition, in the embodiment, when the portable machine body 200 is located in the receiving groove 117, a top surface of the portable machine body 200 does not exceed a top surface of the self-propelled machine body 100. Specifically, the top surface of the portable machine body 200 at the handlebar 260 is leveled with the top surface of the self-propelled machine body 100, so that an overall appearance of the sweeping robot 12 is more complete. Certainly, in other embodiments, when the portable machine body 200 is located in the receiving groove 117, the top surface of the portable machine body 200 may also be higher than the top surface of the self-propelled machine body 100; the invention is not limited thereto.

In the embodiment, when the portable machine body 200 is installed on the self-propelled machine body 100, the first electrical connector 140 of the self-propelled machine body 100 is joined with the second electrical connector 240 of the portable machine body 200, so that the self-propelled machine body 100 is electrically connected to the portable machine body 200. When the portable machine body 200 is installed on the self-propelled machine body 100, the moving module 120 of the self-propelled machine body 100 is electrically connected to the power supply module 230 of the portable machine body 200. That is, the moving module 120 of the self-propelled machine body 100 is powered by the power supply module 230 of the portable machine body 200. Certainly, in other embodiments, a battery may be installed in the self-propelled machine body 100. In other words, the moving module 120 of the self-propelled machine body 100 may be powered by the battery in the self-propelled machine body 100.

In addition, in the embodiment, when the portable machine body 200 is installed on the self-propelled machine body 100, the first circuit board 150 of the self-propelled machine body 100 is electrically connected to the second circuit board 250 of the portable machine body 200, and electrical signals may be transmitted between the first circuit board 150 and the second circuit board 250. The sweeping robot 12, for example, may be configured to receive commands only from the first operation interface 160 of the self-propelled machine body 100. Certainly, in other embodiments, the sweeping robot 12, for example, may also receive commands simultaneously from the first operation interface 160 of the self-propelled machine body 100 and the second operation interface 270 of the portable machine body 200. In an embodiment of the invention, the user may choose to operate the first operation interface 160 of the self-propelled machine body 100 or to operate the second operation interface 270 of the portable machine body 200.

If, for example, the sweeping robot 12 receives commands only from the first operation interface 160 of the self-propelled machine body 100, when the user inputs an activation command (e.g., by pressing a start button) through the first operation interface 160 of the self-propelled machine body 100, the moving module 120 of the self-propelled machine body 100 starts to move, and a moving path of the moving module 120 may be controlled by a controller (not shown) of the first circuit board 150. At this time, the suction motor 220 of the portable machine body 200 is also activated, so that the air flow flows along the vacuum channel collectively formed by the self-propelled machine body 100 and the portable machine body 200 and carries the dust to the first dust-collecting box 130.

As shown in FIG. 6, in the embodiment, when the sweeping robot 12 needs to be charged, the self-propelled machine body 100 includes a third electrical connector 142; when the portable machine body 200 is installed on the self-propelled machine body 100, the third electrical connector 142 is electrically connected to the power supply module 230, and an external power may be transmitted from the third electrical connector 142 to the power supply module 230 via a charging dock (not shown). In addition, the portable machine body 200 provided in the embodiment includes a fourth electrical connector 242 electrically connected to the power supply module 230, and an external power may also be transmitted from the fourth electrical connector 242 to the power supply module 230. That is, the user may choose to connect the sweeping robot 12 to the charging dock so as to charge the power supply module 230 of the portable machine body 200, or the user may choose to directly charge the power supply module 230 of the portable machine body 200.

In addition, in other embodiments, the self-propelled machine body 100 and the portable machine body 200 may have only one circuit board controlling the moving module 120 of the self-propelled machine body 100 and the suction motor 220 of the portable machine body 200.

Moreover, in the embodiment, the electrical signals are transmitted between the self-propelled machine body 100 and the portable machine body 200 via physical connection of two electrical connectors. However, in other embodiments, the first circuit board 150 of the self-propelled machine body 100 and the second circuit board 250 of the portable machine body 200 may achieve a function of transmitting signals to each other through wireless connection. For example, the self-propelled machine body 100 may also include a first wireless communication unit (not shown) electrically connected to the first circuit board 150, and the portable machine body 200 may also include a second wireless communication unit (not shown) electrically connected to the second circuit board 250. The first wireless communication unit and the second wireless communication unit are adapted to transmit wireless signals to each other. In such an embodiment, an electrical connection circuit/wire between the first circuit board 150 of the self-propelled machine body 100 and the second circuit board 250 of the portable machine body 200 may also be omitted.

In other embodiments, if the self-propelled machine body 100 has the battery (not shown), the self-propelled machine body 100 and the portable machine body 200 may also not be electrically nor may signals be transmitted therebetween; instead, the self-propelled machine body 100 and the portable machine body 200 may operate on their own. For example, the user may separately activate the first operation interface 160 of the self-propelled machine body 100 and the second operation interface 270 of the portable machine body 200, so that the moving module 120 of the self-propelled machine body 100 and the suction motor 220 of the portable machine body 200 may operate on their own.

Referring back to FIG. 3 and FIG. 4, the portable machine body 200 provided in the embodiment may be detached from the self-propelled machine body 100 and may be combined with other components (e.g., the suction head assembly 300) to form another electronic device 10 (e.g., the hand-held vacuum cleaner 14). As shown in FIG. 3, the suction head assembly 300 provided in the embodiment includes a second air flow channel 310, a second dust-collecting box 320 connected to the second air flow channel 310, and a third fixing portion 316. When the suction head assembly 300 is installed to the portable machine body 200, the second fixing portion 216 of the portable machine body 200 is fixed to the third fixing portion 316 of the suction head assembly 300, so that the portable machine body 200 and the suction head assembly 300 may be stably combined. The second fixing portion 216 and the third fixing portion 316 provided in the embodiment are a combination of a hook and a slot. In other embodiments, the second fixing portion 216 and the third fixing portion 316 may also be the combination of two magnetic pieces. The type of the second fixing portion 216 and a type of the third fixing portion 316 are not limited thereto.

In the embodiment, when the suction head assembly 300 is installed on the portable machine body 200, the suction motor 220 (shown in FIG. 5) of the portable machine body 200 communicates with the second air flow channel 310 of the suction head assembly 300. Therefore, when the suction motor 220 is activated, the dust-laden air flow may enter the suction head assembly 300 from the second air flow channel 310, the dust may be brought to the second dust-collecting box 320, the air flow passes through a filter 330 and continues to flow along the second air flow channel 310, the second inlet 213 of the portable machine body 200, and the suction motor 220, and then the air flow exits through the second outlet 214. In addition, the user may directly activate or stop the hand-held vacuum cleaner 14 or adjust a suction force of the hand-held vacuum cleaner 14 via the second operation interface 270 of the portable machine body 200.

FIG. 3 and FIG. 4 only schematically illustrate one embodiment of the suction head assembly 300, but the type and the form of the suction head assembly 300 are not limited thereto. For example, the suction head assembly 300 may be a slim-type suction head assembly 300 suitable for being disposed at narrow space, a patting-type suction head assembly 300 suitable for use on a comforter, or a suction head assembly 300 capable of vacuuming a large area, etc.

The self-propelled machine body 100 provided in the embodiment does not have the suction motor 220, so when the portable machine body 200 is not assembled to the self-propelled machine body 100, the self-propelled machine body 100 cannot be actuated alone as the sweeping robot 12. In addition, the suction head assembly 300 also does not have the suction motor 220, so when the portable machine body 200 is not assembled to the suction head assembly 300, the suction head assembly 300 also cannot be used alone. In other words, the self-propelled machine body 100 and the suction head assembly 300 provided in the embodiment respectively share the same portable machine body 200. According to the needs of the user, the user may choose to connect the portable machine body 200 to the self-propelled machine body 100 to be actuated as the sweeping robot 12 or choose to connect the portable machine body 200 to the suction head assembly 300 to be actuated as the hand-held vacuum cleaner 14. Therefore, the electronic device is quite convenient to use.

Besides, in the embodiment, when the portable machine body 200 is installed on the self-propelled machine body 100 or the suction head assembly 300, the vacuum channels of the sweeping robot 12 or the hand-held vacuum cleaner 14 are mostly provided by the first air flow channel 115 of the self-propelled machine body 100 or the second air flow channel 310 of the suction head assembly 300 as shown in FIG. 7. In other words, only the second inlet 213 through which the air flow is guided in by the suction motor 220 and the second outlet 214 through which the air flow is pushed out by the suction motor 220 are disposed in the second housing 210 of the portable machine body 200. Such a design may reduce the volume and the weight of the portable machine body 200. Moreover, the first dust-collecting box 130 and the second dust-collecting box 320 are respectively disposed in the self-propelled machine body 100 and the suction head assembly 300, and the portable machine body 200 does not have any dust-collecting box, thereby reducing the volume and the weight of the portable machine body 200.

In other embodiments, the portable machine body 200 may be optionally connected to other types of components to be actuated as another electronic device 10 requiring the suction force. In addition, in other embodiments, a position of the portable machine body 200 where other components are connected is not limited to the second inlet 213. For example, other components may also be optionally connected to the second outlet 214 of the portable machine body 200 to be actuated as an electronic element requiring a blowing force. In an embodiment, if a blowing head assembly (not shown) is connected to the second outlet 214 of the portable machine body 200, the portable machine body 200 and the blowing head assembly may be collectively actuated as a blow dryer or a leaf blower, etc. Certainly, the type of the electronic device to which the portable machine body 200 may be applied is not limited thereto.

To sum up, the portable machine body of the electronic device provided in one or more embodiments of the invention is detachably installed on the self-propelled machine body. When the portable machine body is installed on the self-propelled machine body, the suction motor of the portable machine body communicates with the first air flow channel of the self-propelled machine body. Therefore, when the suction motor of the portable machine body is started, the first air flow channel of the self-propelled machine body may correspondingly become the portion of the vacuum channel, so that the self-propelled machine body and the portable machine body may be collectively actuated as the sweeping robot with automatic moving and vacuuming functions. In addition, the portable machine body may also be detached from the self-propelled machine body, and the portable machine body not installed on the self-propelled machine body may be combined with other components (e.g., the suction head assembly). When the suction head assembly is installed on the portable machine body, the portable machine body and the suction head assembly may be collectively actuated as the hand-held vacuum cleaner. In other words, the electronic device provided in one or more embodiments of the invention may be combined with different components to optionally become different types of electronic cleaning devices. As such, a user of the electronic device provided herein may enjoy diverse usage modes at less costs, and the storage space for the electronic device may be reduced.

It will be apparent to those skilled in the art that various modifications and variations can be made to the structure described in the disclosure without departing from the scope or spirit of the disclosure. In view of the foregoing, it is intended that the disclosure cover modifications and variations provided they fall within the scope of the following claims and their equivalents.

What is claimed is:

1. An electronic device, comprising:

a self-propelled machine body, comprising a first dust-collecting box, a moving module and a first air flow channel connected to the first dust-collecting box; and a portable machine body, detachably installed on the self-propelled machine body and comprising a housing having an inlet and an outlet and a suction motor disposed in the housing and communicating with the inlet and the outlet, wherein when the portable machine body is installed on the self-propelled machine body, the suction motor of the portable machine body communicates with the first air flow channel of the self-propelled machine body, and the self-propelled machine body and the portable machine body are collectively actuated as a sweeping robot, so that air flows from outside of the self-propelled machine body and out of the portable machine body through the first air flow channel, the first dust-collecting box, the inlet, the suction motor, and the outlet; and when the portable machine body is detached from the self-propelled machine body, the portable machine body is capable of being detachably connected to an auxiliary component, so that the portable machine body and the auxiliary component are adapted to be collectively actuated as a hand-held device.

2. The electronic device of claim 1, wherein the auxiliary component is a suction head assembly, wherein when the suction head assembly is installed on the portable machine body at the inlet, the portable machine body and the suction head assembly are adapted to be collectively actuated as a hand-held vacuum cleaner.

3. The electronic device of claim 2, wherein the suction head assembly comprises a second air flow channel and a second dust-collecting box connected to the second air flow channel, wherein when the suction head assembly is installed on the portable machine body, the suction motor of the portable machine body communicates with the second air flow channel of the suction head assembly.

4. The electronic device of claim 1, wherein the portable machine body comprises a handlebar and an operation interface.

5. The electronic device of claim 1, wherein the portable machine body comprises a power supply module electrically connected to the suction motor, and when the portable machine body is installed on the self-propelled machine body, the moving module of the self-propelled machine body is electrically connected to the power supply module of the portable machine body.

6. The electronic device of claim 5, wherein the self-propelled machine body comprises a first electrical connector electrically connected to the moving module, the portable machine body comprises a second electrical connector electrically connected to the power supply module, and when the portable machine body is installed on the self-propelled machine body, the first electrical connector is joined with the second electrical connector.

7. The electronic device of claim 1, wherein the self-propelled machine body comprises a first electrical connector and a first circuit board electrically connected to the first electrical connector, the portable machine body comprises a second electrical connector and a second circuit board electrically connected to the second electrical connector, and when the portable machine body is installed on the self-propelled machine body, the first electrical connector is joined with the second electrical connector, so that the first circuit board is electrically connected to the second circuit board.

8. The electronic device of claim 1, wherein the self-propelled machine body comprises an electrical connector, when the portable machine body is installed on the self-propelled machine body, the electrical connector is electrically connected to the power supply module, and an external power is adapted to be transmitted from the electrical connector to the power supply module.

9. The electronic device of claim 1, wherein the portable machine body comprises an electrical connector electrically connected to the power supply module, and an external power is adapted to be transmitted from the electrical connector to the power supply module.

10. The electronic device of claim 1, wherein the self-propelled machine body comprises a first housing, the moving module is rotatably disposed at the first housing, the first housing comprises a first inlet, a first outlet, and the first air flow channel communicating with the first inlet and the first outlet, the portable machine body comprises a second housing, the suction motor is disposed in the second housing, the second housing comprises a second inlet and a second outlet, the suction motor communicates with the second inlet and the second outlet, and when the portable machine body is installed on the self-propelled machine body, the second inlet is connected to the first outlet.

11. The electronic device of claim 10, further comprising:

an elastic washer, disposed at the first outlet of the first housing or disposed at the second inlet of the second housing.

12. The electronic device of claim 1, wherein the self-propelled machine body comprises a first housing having a receiving groove, and when the portable machine body is installed on the self-propelled machine body, the portable machine body is located in the receiving groove.

13. The electronic device of claim 12, wherein the receiving groove communicates with the first air flow channel.

14. The electronic device of claim 12, wherein the first housing comprises a plurality of position-limiting walls surrounding the receiving groove, and the plurality of position-limiting walls are respectively adapted to limit the portable machine body located in the receiving groove so as to prevent the portable machine body from moving in a plurality of directions relative to the self-propelled machine body.

15. The electronic device of claim 1, wherein the self-propelled machine body comprises a first fixing portion, the portable machine body comprises a second fixing portion, and when the portable machine body is installed on the self-propelled machine body, the second fixing portion is fixed to the first fixing portion.

16. The electronic device of claim 15, wherein the first fixing portion and the second fixing portion are a combination of a hook and a slot or a combination of two magnetic pieces.

17. The electronic device of claim 1, wherein the moving module comprises a wheel or a track.

18. An electronic device, comprising:

a self-propelled machine body, comprising a moving module, a first air flow channel, a first electrical connector and a first circuit board electrically connected to the first electrical connector; and a portable machine body, detachably installed on the self-propelled machine body and comprising a suction motor, a second electrical connector, and a second circuit board electrically connected to the second electrical connector; wherein the suction motor of the portable machine body communicates with the first air flow channel of the self-propelled machine body, and the self-propelled machine body and the portable machine body are collectively actuated as a sweeping robot, and when the portable machine body is installed on the self-propelled machine body, the first electrical connector is joined with the second electrical connector, so that the first circuit board is electrically connected to the second circuit board.

19. An electronic device, comprising:

a self-propelled machine body, comprising a moving module, a first air flow channel, and a first housing, wherein the moving module is rotatably disposed at the first housing, and the first housing comprises first inlet, a first outlet, and the first air flow channel communicating with the first inlet and the first outlet; and a portable machine body, detachably installed on the self-propelled machine body and comprising a suction motor and a second housing, wherein the suction motor is disposed in the second housing, the second housing comprises a second inlet and a second outlet, the suction motor communicates with the second inlet and the second outlet, and when the portable machine body is installed on the self-propelled machine body, the second inlet is connected to the first outlet; wherein when the portable machine body is installed on the self-propelled machine body, the suction motor of the portable machine body communicates with the first air flow channel of the self-propelled machine body, and the self-propelled machine body and the portable machine body are collectively actuated as a sweeping robot.

20. The electronic device of claim 19, further comprising:

an elastic washer, disposed at the first outlet of the first housing or disposed at the second inlet of the second housing.

* * * * *